US006267376B1

(12) United States Patent
Jenkins

(10) Patent No.: US 6,267,376 B1
(45) Date of Patent: Jul. 31, 2001

(54) TRIVIA GAME

(76) Inventor: Brett C. Jenkins, 5692 172nd Ter., Portland, OR (US) 97229

( * ) Notice: Subject to any disclaimer, the term of this patent is extended or adjusted under 35 U.S.C. 154(b) by 0 days.

(21) Appl. No.: 09/309,912

(22) Filed: May 11, 1999

Related U.S. Application Data

(60) Provisional application No. 60/085,518, filed on May 14, 1998.

(51) Int. Cl.[7] ..... A63F 3/00

(52) U.S. Cl. ..... 273/258; 273/430; 273/431

(58) Field of Search ..... 273/429, 430, 273/431, 243, 249, 258

(56) References Cited

U.S. PATENT DOCUMENTS

| | | | |
|---|---|---|---|
| 3,414,264 | * | 12/1968 | Schriber . |
| 4,029,320 | * | 6/1977 | Hausman . |
| 4,090,717 | | 5/1978 | Rossetti . |
| 4,121,823 | | 10/1978 | McBride . |
| 4,273,337 | | 6/1981 | Carrera et al. . |
| 4,679,796 | * | 7/1987 | Rein . |
| 4,714,255 | | 12/1987 | Henry et al. . |
| 4,856,780 | | 8/1989 | Begley et al. . |
| 4,889,345 | | 12/1989 | Wawryk . |
| 4,907,808 | | 3/1990 | Turner et al. . |
| 5,042,816 | | 8/1991 | Davis et al. . |
| 5,121,928 | | 6/1992 | Salerno-Sonneberg . |
| 5,152,535 | | 10/1992 | Roberts . |
| 5,156,407 | * | 10/1992 | Moore . |
| 5,297,801 | * | 3/1994 | Croker . |
| 5,472,207 | * | 12/1995 | Sullivan, Jr. et al. . |
| 5,501,456 | * | 3/1996 | Collins et al. . |
| 5,607,160 | | 3/1997 | Stevens et al. . |
| 6,019,372 | * | 2/2000 | Polaski et al. . |

FOREIGN PATENT DOCUMENTS

| | | |
|---|---|---|
| 2626779 | 8/1989 | (FR) . |
| 2672228 | 8/1992 | (FR) . |
| 2021959 | 12/1979 | (GB) . |
| 2200291 | 8/1988 | (GB) . |
| 2219744 | 12/1989 | (GB) . |

* cited by examiner

*Primary Examiner*—William M. Pierce
(74) *Attorney, Agent, or Firm*—Richard C. Littman

(57) ABSTRACT

A trivia game includes a game board having a plurality of linear playing paths extending from one end of the board to the other, and a plurality of question and response cards each having a series of questions of differing levels of difficulty and corresponding answers. Players may select whichever level of difficulty they may wish, with advance of that player's position marker along the corresponding playing path, depending upon the degree of difficulty of the question correctly answered. The position marker of a player incorrectly answering a question, is set back a number of positions corresponding to the degree of difficulty of the question. The game also allows players to set back the progress of an opposing player, if desired. A player correctly responding to a question at a predetermined level (e. g., the highest level) may advance his/her own position marker accordingly, or may elect to set back an opponent's marker some number of spaces (e. g., half the number of spaces which could otherwise be advanced). The ability to set back the progress of a leading player, adds considerably to the excitement and suspense of the present game. The rules may be applied to a travel version, with score being kept conventionally (paper or and pencil, etc.), with points being added and subtracted according to the rules of play. The present game could be applied to virtually any subject matter, but is particularly well suited for television trivia, especially current and/or retired situation comedies.

14 Claims, 4 Drawing Sheets

32

TRIVIA GAME

REFERENCE TO RELATED PATENT APPLICATION

This application claims the benefit of U.S. Provisional Patent Application Ser. No. 60/085,518, filed on May 14, 1998.

BACKGROUND OF THE INVENTION

1. Field of the Invention

The present invention relates generally to board games, and more specifically to a trivia game involving multiple levels of difficulty selectable by each of the players. Players providing a correct response at the highest level of difficulty, have the option of advancing their own position marker, or alternatively setting back the position marker of another player, as desired.

2. Description of the Related Art

Various board games testing the knowledge and/or skill of the players, have been known for centuries. More recently, games involving the testing of trivial knowledge (e. g., Trivial Pursuit, ™) have become popular. Such games generally involve a peripheral or other playing path described over a portion of the board, with the playing path being common to all players. Players advance position markers along the playing path according to the degree of success of each in correctly responding to randomly selected questions, usually contained in a deck of question and answer cards.

The results of such a game are generally straightforward, with players having a greater knowledge in the given subject or field of the game, almost always winning the game. Each player's fate is in his or her own hands in such a game, and there is nothing any of the other players can do to alter the course of success of such a superior player. Once such a player approaches the end point of the game, the result is a foregone conclusion.

Accordingly, a need will be seen for a question and response game with rules or procedures allowing players to retard or set back the progress of other players, under certain circumstances of play. The game is played on a board having a series of parallel playing paths thereon, with each player using a single one of the paths. The winning player is the first to move one's position marker from one end of the board (or path) to the other, in accordance with the rules. Opposing players may restrict or reverse the progress of a player by correctly answering a question, preferably at a higher level of difficulty, and choosing to move the player's marker back rather than advancing their own marker. An incorrect response results in the corresponding position marker being set back a corresponding number of positions, depending upon the level of difficulty of the selected question. While the present game may be played using questions from virtually any subject area, it is particularly directed to the use of trivia questions based upon television programs, and more particularly upon current or past situation comedies ("sitcoms").

A discussion of the related art of which the present inventor is aware, and its differences and distinctions from the present invention, is provided below.

U.S. Pat. No. 4,090,717 issued on May 23, 1978 to Susan Rossetti, titled "Educational Game," describes a board game having a game board with a single sinusoidal path thereover. Separate question cards and answer cards are provided, with each card having only a single question or answer thereon.

A single die is used to determine the number of positions advanced by each player after a correct response to a question. No means for setting back the progress of an opponent, is provided by Rossetti. In contrast, the present game provides both questions and corresponding correct responses on opposite sides of a single card, thereby eliminating any possibility of non-corresponding question and answer cards becoming mixed together. Each of the cards of the present game includes a series of questions, and their corresponding answers, having various degrees of difficulty, unlike the single question and answer cards of the Rossetti game. No chance element is provided in the present game; the advance of a given player's position marker is entirely dependent upon the knowledge of that player. However, the present game provides an added element of interest by allowing a player to set back the position marker of an opposing player, if the first player is able to answer a question correctly at the highest level of difficulty and chooses to use his or her move to set back the opposing player.

U.S. Pat. No. 4,121,823 issued on Oct. 24, 1978 to Tarrie A. McBride, titled "Educational Device Employing A Game Situation," describes a game having a game board with a single peripheral playing path therearound. Questions and answers are provided on a series of different decks of cards, with each deck pertaining to a slightly different subject area corresponding to a position on the game board, thus opening the possibility of mixing different decks. No means for setting back the progress of another player is provided by McBride in her game. The present game utilizes only a single deck of question and answer cards, with questions on one side of the card and answers on the opposite side. All players select a single card randomly from the deck regardless of their position on the board. The provision for setting back the progress of another player by successfully answering a question of the highest level of difficulty, the plurality of paths on the game board, and other features, render the present game different from the McBride game.

U.S. Pat. No. 4,273,337 issued on Jun. 16, 1981 to Michael A. Carrera et al., titled "Family Sex Education Board Game," has a game board with a single peripheral path therearound and a series of different groups of question cards, each of a different level of difficulty. Additional discussion and bonus cards are also provided. The Carrera et al. cards must be carefully kept from being mixed with one another in order to retain the qualities of the game, whereas the present cards form a single deck. Moreover, Carrera et al. require a separate answer book, whereas the questions and corresponding answers of the present game are included on opposite sides of single cards. Carrera et al. do not provide any penalty or setback for incorrect answers, do not provide for a player to set back the progress of another player under certain circumstances, include chance means in the play of the game, and provide a separate score sheet and score marking pegs, each of which features is different from the present game.

U.S. Pat. No. 4,714,255 issued on Dec. 22, 1987 to Daniel P. Henry et al., titled "Educational Board Game," describes a game having a game board with a complex pair of intersecting playing paths thereon, unlike the present game board. Chance means are used to determine the distance traveled at each play, unlike the present game. A correctly answering player continues to roll the die and advance, so long as he or she continues to answer each question correctly at each play, unlike the present game. No means is provided for setting back the position of another player, nor being set back for incorrectly answering a question, as in the present game. Henry et al. provide different levels of difficulty, but the level must be selected at the beginning of the game by each player, and may only be changed according to certain specific rules and locations of the game board during play, unlike the present game where each player may select any level of difficulty desired at each turn.

U.S. Pat. No. 4,856,780 issued on Aug. 15, 1989 to Samuel E. Begley et al., titled "Sports Trivia Board Game," describes a question and response game having questions of different levels of difficulty. Progress about the peripheral path of the game board, and the difficulty of the questions provided to the players during play, is determined purely by chance means, with the players having no input. Thus, a player of the Begley et al. game may by chance advance only a single position on the board, yet be required to answer a question at the highest level of difficulty, unlike the present game. As the score is maintained on a separate sheet in the Begley et al. game, no provision is made to set back the position of a player marker for an incorrect answer, as provided for in the present game. Moreover, Begley et al. make no provision for setting back an opposing player's marker, when another player correctly responds to a question at a given level of difficulty, as provided for in the present game.

U.S. Pat. No. 4,889,345 issued on Dec. 26, 1983 to Randy A. Wawryk, titled "Board Game," describes a game having a board with a double peripheral playing path and multiple scoring levels, unlike the present game board with its separate playing paths for each player. Advancement about the board is determined by chance means, unlike the present game. Question and answer cards are provided by Wawryk, but are divided into five different categories, unlike the present question and answer cards. Wawryk makes no provision for player position advancement according to the level of difficulty of questions answered, as in the present game, nor does he provide any means for setting back an opposing player's marker when another player correctly answers a question at a given level of difficulty, as provided in the present game.

U.S. Pat. No. 4,907,808 issued on Mar. 13, 1990 to Glenn Turner et al., titled "Trivia Board Game," describes a game having a game board with a hexagonal configuration and radial and peripheral playing paths, unlike the game board of the present game. Player position markers must be progressively assembled according to player progress during the course of the game. Progress along the playing paths is determined by chance means, with players being required to answer questions selected from one of several groups of cards, unlike the single pack of cards of the present game. While one of the groups of cards of the Turner et al. game is divided into questions relating to different subject areas, Turner et al. do not describe any differing levels of difficulty for their questions, as provided in the present game. Moreover, Turner et al. are silent regarding any provision for setting back an opposing player, or for advancement of a position marker according to the degree of difficulty of a correctly answered question, as provided in the present game.

U.S. Pat. No. 5,042,816 issued on Aug. 27, 1991 to Tracy L. Davis et al., titled "Biblical Question And Answer Game," describes a game having a game board with a peripheral path and at least one crossing path, unlike the game board of the present invention. Davis et al. provide different groups of cards, unlike the present game. One group has plural questions on each card, but the questions are selected by chance means and do not differ in difficulty, as do the present cards. Moreover, Davis et al. do not provide means to set back the progress of an opposing player.

U.S. Pat. No. 5,121,928 issued on Jun. 16, 1992 to Nadja Salerno-Sonneberg, titled "Method Of Playing A Question And Answer Movie Board Game," describes a game with a board having a peripheral playing path, unlike the present game board. The winner of the game is determined by collecting a predetermined number of markers, each of which corresponds to a category of questions. Players must correctly answer a predetermined number of questions in a given category in order to collect a marker for that category. In contrast, the question and answer cards of the present game comprise only a single group, with each card including a plurality of questions of differing levels of difficulty. The winner of the present game is the first player to advance along his or her individual playing path to its end. No chance means is used in the play of the present game, as opposed to the Salerno-Sonneberg game.

U.S. Pat. No. 5,152,535 issued on Oct. 6, 1992 to Adolph Roberts, titled "Bible Quiz Game," describes a game having a game board with playing paths of different levels of difficulty. Players select the level of difficulty desired at the beginning of the game and are restricted to that level throughout the game, rather than being allowed to select a question of a certain level of difficulty at each turn, as in the present game. "Freeze" cards are provided for a player to restrict an opponent from advancing, but this differs from the present game in that (1) the "freeze" cards may only be used against an opponent positioned on one of the penultimate positions of the game board paths, and (2) no means is provided for setting back the position of an opposing player.

U.S. Pat. No. 5,607,160 issued on Mar. 4, 1997 to Arthur J. Stevens et al., titled "Three Talent Boardgame," describes a game having a triangular board with intersecting arcuate playing paths thereon. The playing paths are divided into a series of three different types of positions, requiring teams of players to answer a series of three questions, draw representations of three different articles, or act out representations of three different words, depending upon the position. Chance means is used to determine the number of positions to be moved on each team's turn, unlike the present game in which the distance advanced is determined according to the difficulty of the question selected by the player. Stevens et al. provide no means for setting back the progress of a player in the event of an incorrect response, and/or for setting back the progress of an opponent if a first player responds correctly to a question at a predetermined level of difficulty.

British Patent Publication No. 2,021,959 published on Dec. 12, 1979 to Keith H. Lillie, titled "Steeple Chase Game," describes a game having a board with a continuous, circuitous playing path thereon, unlike the present game board. Advancement along the playing path is determined by chance means, unlike the present game. Questions are only provided at certain obstacle points along the path, rather than being a requirement for advancement, as in the present game. Also, Lillie does not disclose any means of setting back an opposing player's marker when a first player correctly responds to a question at a given level of difficulty.

British Patent Publication No. 2,200,291 published on Aug. 3, 1988 to Kitfix Swallow Group, Ltd., titled "Board Games," describes a game having a game board with a series of convoluted, branching playing paths thereon, unlike the present board. Each of the paths is divided into a series of positions, with different players or teams advancing along each of the branches. Players must correctly answer questions corresponding to the specific subject area of the respective branch selected. Additional cards are provided, which are awarded to players or teams reaching the ends of their respective branches. Play continues until at least one player returns along his or her respective branch to a finishing position. The amount of advancement is determined by chance means, rather than being selected by the player as in the present game, and no means is provided for setting back an opponent or for setting back the progress of a given player in the event of an incorrect response, as in the present game.

British Patent Publication No. 2,219,744 published on Dec. 20, 1989 to Gillian M. Rowland, titled "Game Apparatus," describes a game having a game board with a peripheral playing path therearound. Moves are determined by chance means with players being required to answer a question if they land on certain positions about the board, unlike the present game where players must answer a question at each turn but select the degree of difficulty and corresponding advancement (or set back) themselves. Rowland provides for a set back in the event of an incorrectly answered question, but does not provide for set back of an opponent.

French Patent Publication No. 2,626,779 published on Aug. 11, 1989 illustrates a board game with the board having a sinusoidal playing path. Chance means are used to determine the advancement of player position markers along the board, unlike the present game. No questions having different levels of difficulty are disclosed in the English abstract of the reference, nor is there any mention of the set back of position markers in the event of an incorrectly answered question or of setting back an opposing position marker under certain circumstances, as provided in the present game.

French Patent Publication No. 2,672,228 published on Aug. 7, 1992 illustrates a board game having a board representing a global map, unlike the present game board. According to the English abstract, a pair of dice each having different markings thereon is used to determine the question to be responded to by a player, and various penalties. Players answering successfully receive a marker in an indicator or scoring area of the board, unlike the present game. No means for setting back the progress of an opponent when a first player correctly answers a question, or for setting back the progress of a player when that player answers incorrectly, is disclosed in this reference, which features are both provided for in the present game.

Finally, the December, 1994 issue of Games Magazine, pages 24 and 25, describes a trivia game involving questions taken from various subject areas of other trivia games. The game board and rules are generally conventional, with the board comprising a peripheral playing path, unlike the present game board. Chance means are used to determine the advance of player position markers about the board, unlike the present game. Players continue to play so long as they are able to answer questions correctly, unlike the present game. No means is disclosed for setting back the position markers of any of the players, as provided in the present game.

None of the above inventions and patents, taken either singly or in combination, is seen to describe the instant invention as claimed.

SUMMARY OF THE INVENTION

The present invention comprises a trivia board game for a plurality of players or teams. The game board comprises a series of straight, parallel playing paths extending from one side of the board to the other, with the first player to travel the length of the board being the winner of the game. A plurality of question and answer cards is provided, with each of the cards having a series of questions of varying degrees of difficulty, and corresponding answers, on opposite sides thereof. No chance means (dice, spinners, etc.) is used in the play of the present game. Rather, each player or team determines the degree of difficulty of the question to which they wish to respond. The advance of a player's position marker along the corresponding playing path is determined by the degree of difficulty of the question selected, with correct answers to more difficult questions being rewarded with greater advances.

The position marker of a player incorrectly answering a question is set back a number of positions according to the degree of difficulty of the question. Also, the present game provides means for setting back the progress of another player under certain circumstances. For example, if a player has established a lead and an opposing player correctly answers a question at a predetermined level of difficulty, the correctly answering player has the option of advancing their own position marker accordingly, or setting back the marker of the leading (or other) player, as desired. The present game may be adapted for use with questions relating to virtually any subject or subjects, but the present disclosure is directed to a trivia game relating to current and/or retired television situation comedies ("sitcoms"). Different game board embodiments are provided, each having a series of separate, parallel playing paths. The present game may be played using pencil and paper for scorekeeping, as well, with no board being required.

Accordingly, it is a principal object of the invention to provide an improved board game for testing and challenging the knowledge of players on a given subject area.

It is another object of the invention to provide an improved board game including a plurality of question and answer cards, with each of the cards including a plurality of questions thereon of varying degrees or levels of difficulty and corresponding answers on opposite sides of the card.

It is a further object of the invention to provide an improved board game having a game board comprising a plurality of linear playing paths, each extending substantially from one end of the board to the other.

An additional object of the invention is to provide an improved board game in which players may select the degree of difficulty of the question to which they are to respond, and advance their position marker according to the difficulty of the question in the event of a correct response.

Yet another object of the invention is to provide an improved board game in which the position marker of a player is set back according to the degree of difficulty of the question, when the player responds incorrectly.

Still another object of the invention is to provide an improved board game in which players successfully answering a question at a predetermined level of difficulty, may optionally set back the position marker of an opposing player in lieu of advancing their own marker.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
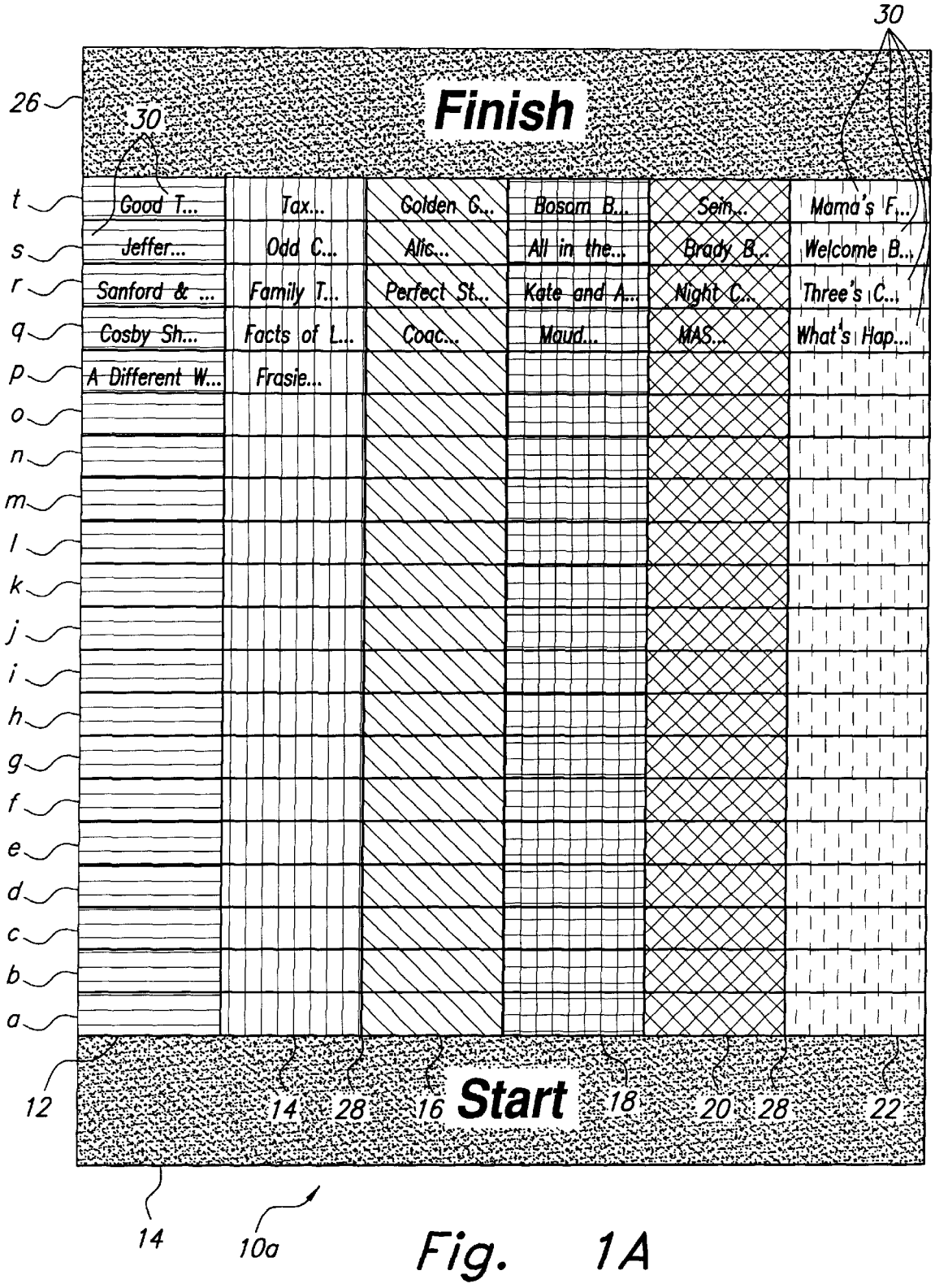
FIG. 1A is a plan view of a first embodiment of the game board of the present board game invention, showing its various features.

The present invention comprises a board game in which players advance by providing correct answers to questions asked during the course of the game, as in a trivia question type game. FIGS. 1A illustrates a game board 10*a*, with the board 1*a* containing a plurality of linear, parallel playing paths designated by even numbers 12 through 22 and extending from a first or starting end 24 of the board 10*a* to the opposite finishing end 26. Each of the even numbered playing paths 12 through 22 is separated from one another by a line 28, and may be made further distinct from one another by means of different colors, e. g., the first path 12 may be colored blue, the second path 14 red, the third path 16 green, the fourth path 18 yellow, the fifth path 20 orange, and the sixth path 22 purple or violet. Other colors may be used as desired, or some other means of making the paths 12 through 22 distinct from one another (background patterns, etc) may be provided as desired. Also, it will be seen that more or fewer paths may be provided on such a board as desired.

Each of the even numbered paths 12 through 22 of the board 10*a* is divided into an equal number of rows or playing positions, designated as positions a through t from the starting position 24 to the finishing position 26 on the board 10*a* of FIG. 1A. Thus, the tenth row position j of the third column 16 would be designated as position 16*j*, etc., in describing the various specific positions of the board 10*a*. It will be seen that a larger or smaller number of such rows or playing positions may be provided on the board 10*a*, as desired.

Each of the playing positions may include a trivia subject thereon, such as the exemplary partial titles 30 of various television situation comedies indicated in positions 12*p*, 14*p*, and even numbered positions 12*q* through 22*t* of the board 10*a*. These subjects may be repeated on the remaining board positions as desired. While the subjects do not enter directly into the play of the present game, they are useful in indicating the general subject matter of the question and response cards used in a given game according to the present invention, such as the exemplary television situation comedy questions described in the present disclosure. Other subject matter (various sports, general knowledge, politics, history, science, etc.) may be used in lieu of the exemplary television program titles shown in FIG. 1A, or the various positions of the board may be left blank if desired. For example, the names of various baseball teams, or major league sports teams in general, could be included in the various board positions for a game directed to sports trivia.

Figure 1B:
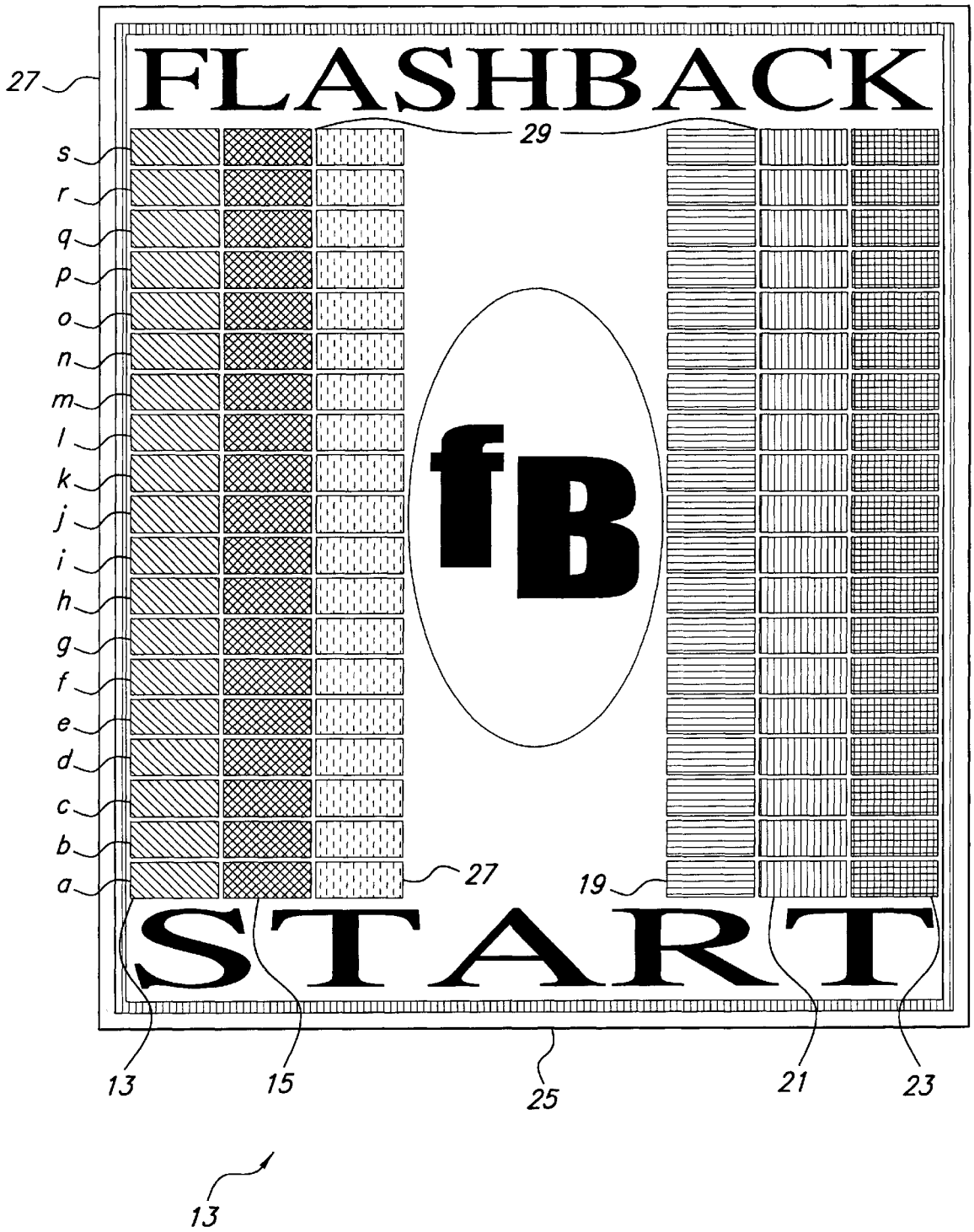
FIG. 1B is a plan view of an alternative second embodiment game board of the present board game invention.

FIG. 1B provides a view of an alternative board layout, designated as board 10*b*. The board 10*b* includes a series of linear, parallel playing paths or columns, respectively designated as paths 13, 15, 17, 19, 21, and 23 and extending from a first or starting end 25 of the board 10*b* to the opposite finishing end 27, in a manner similar to that described for the board 10*a* shown in FIG. 1A. However, it will be noted that the odd numbered paths or columns 13 through 23 are separated by a wide area or zone in the center thereof, which may be used for the placement of a logo, future expansion for additional paths or columns, etc., as desired. Each of the odd numbered playing paths 13 through 23 is separated from one another by a line 29, and may be made further distinct from one another by means of different colors, patterns, etc., in the manner described further above for the board 10*a* of FIG. 1A. Also, it will be seen that more or fewer paths may be provided on such a board 10*a* as desired, as in the case of the board 10*a* of FIG. 1A.

Each of the odd numbered paths 13 through 23 of the board 10*b* is divided into an equal number of rows or playing positions, designated as positions a through s from the starting position 25 to the finishing position 27, as in the case of the board 10*a* of FIG. 1A. (While one less position is shown on the board 10*b* than on the board 10*a*, it will be seen that the exact number of positions may be adjusted as desired in either board embodiment.) Thus, the tenth row position j of the third column 17 of the board 10*b* would be designated as position 17*j*, etc., in describing the various specific positions of the board 10*b*.

Each of the playing positions of the board 10*b* may include a trivia subject thereon, such as the exemplary partial titles 30 of various television situation comedies indicated in positions 12*p*, 14*p*, and even numbered positions 12*q* through 22*t* of the board 10*a*. These subjects may be repeated on the remaining board positions as desired. While the subjects do not enter directly into the play of the present game, they are useful in indicating the general subject matter of the question and response cards used in a given game according to the present invention, such as the exemplary television situation comedy questions described in the present disclosure. As noted in the discussion of the board 10*a* of FIG. 1A, other subject matter (various sports, general knowledge, politics, history, science, etc.) may be used in lieu of the exemplary television program titles shown in FIG. 1A, or the various positions of the board may be left blank if desired.

Figure 2A:
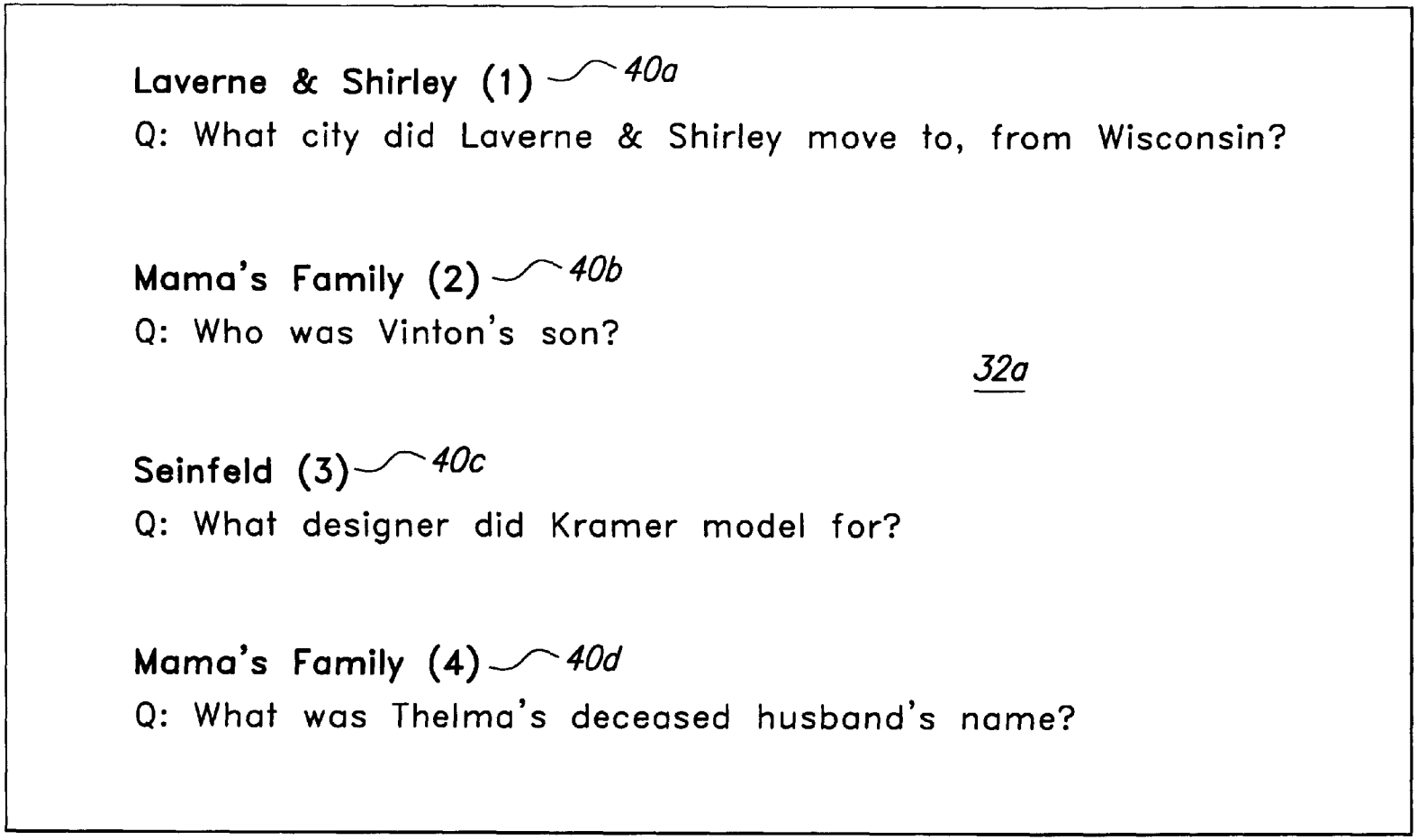
FIG. 2A is a view of the question side or face of an exemplary question and answer game card of the present game, illustrating the plurality of questions and degree of difficulty of those questions, as well as other features.
Figure 2B:
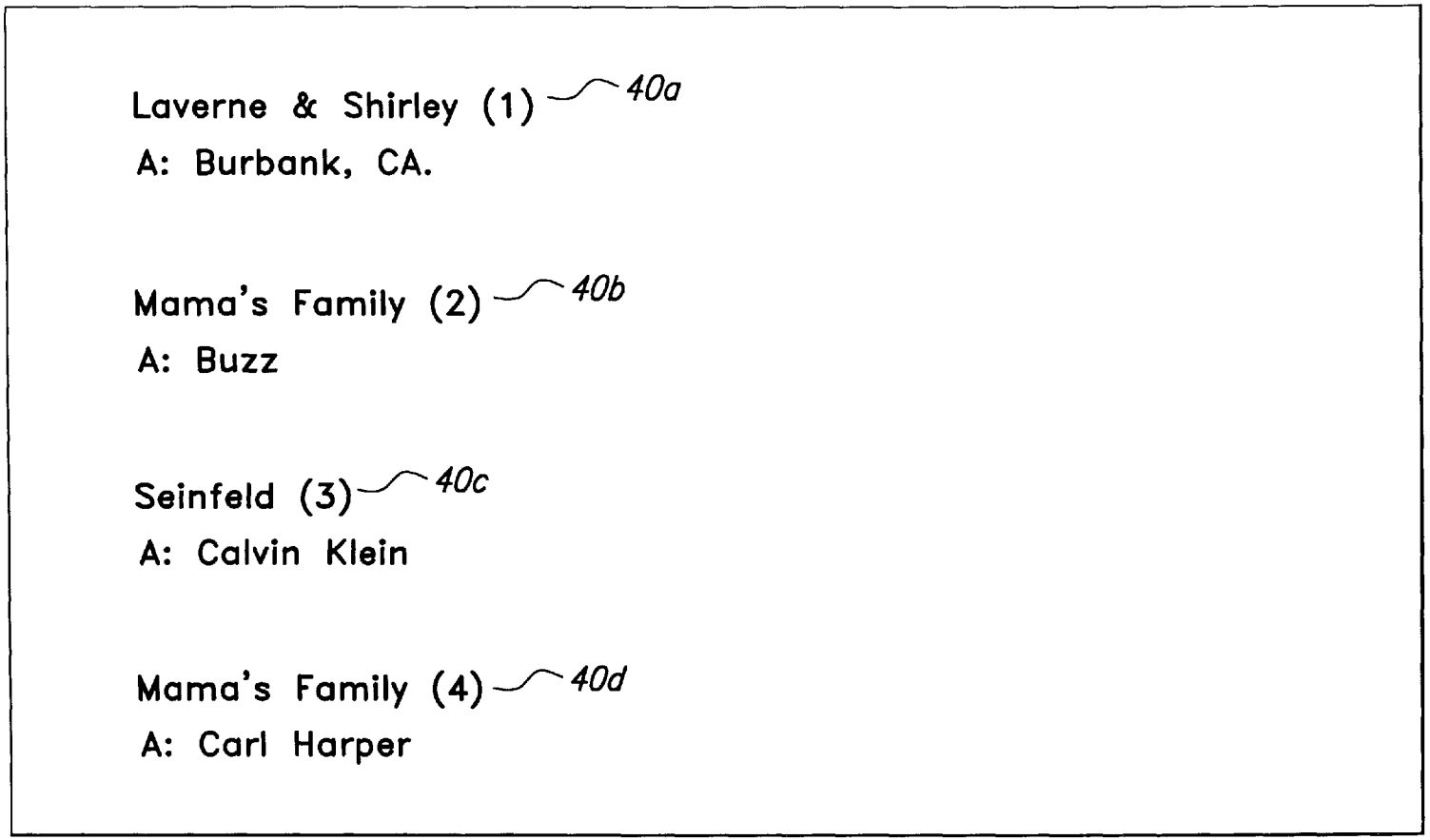
FIG. 2B is a view of the opposite side or face of the card of FIG. 2A, showing the plurality of answers corresponding to the questions of the card face of FIG. 2A.

FIGS. 2A and 2B illustrate an exemplary question and response card 32 of the present game. Each of the cards 32 of the present game has a first side or face 32*a* which includes a series of questions relating to the subject matter of the present game, e.g., questions 34*a* through 34*d* of the card face 32*a* of FIG. 2A. The opposite second side or face 32*b*, shown in FIG. 2B, includes answers 36*a* through 36*d* corresponding to the respective questions 34*a* through 34*d* of the first card face 32*a* of FIG. 2A. As in the number of columns and position rows of the game boards 10*a* and 10*b* respectively of FIGS. 1A and 1B, a larger or smaller number of questions and answers could be included on each card 32, but the provision of four questions and corresponding answers provides a good balance between a reasonable degree of choice and avoidance of overcrowding the information on each card 32.

Each of the questions 34*a* through 34*d* and answers 36*a* through 36*d* may include the corresponding title 38*a* through 38*d* of the television show from which the question is taken, along with a corresponding number 40*a* through 40*d* indicating the degree or level of difficulty of the respective question 34*a* through 34*d*. Preferably, the questions 34*a* through 34*d* on the first face 32*a* of each card 32 are of varying levels of difficulty. The questions 34*a* through 34*d* are preferably arranged according to their difficulty as in the card 32 with the easiest question 34*a* and the title 38*a* of the corresponding television program from which the question and answer are taken, positioned near the top of the card face 32*a*, and the most difficult question 34*d* and its corresponding program title 38*d* located near the bottom of the card face 32*a*. The corresponding answers 36*a* through 36*d* are arranged in like order on the opposite face 32*b* of the card 32, with the answer 36*a* for the least difficult question 34*a* being near the top of the card face 32*b*, and the answer 36*d* for the most difficult question 34*a* near the bottom of the card face 32*b*. A table illustrating several possible questions, correct responses to those questions, corresponding program titles, and levels of difficulty, is provided below.

TABLE I.

QUESTION AND RESPONSE CARD INFORMATION

| PROGRAM TITLE | QUESTION | ANSWER | LEVEL OF DIFFICULTY |
|---|---|---|---|
| "Cheers" | Who did Rebecca marry? | Carl | 1 |
| "Night Court" | Who was the prostitute who had a crush on Harry? | Carla | 2 |
| "Laverne & Shirley" | Who was Shirley's boyfriend in Milwaukee? | Carmine Raguso | 3 |
| "Happy Days" | What did Fonzie attempt to jump on his motorcycle? | cars | 4 |
| "Cosby Show" | Name the Huxtable children from oldest to youngest. | Cassandra, Denise, Theo, Vanessa, Rudy | 1 |
| "Happy Days" | Who was Fonzie's cousin? | Chachi | 2 |
| "Night Court" | Who played Mack Robinson? | Charles Robinson | 3 |
| "Golden Girls" | What was Rose's husband's name? | Charlie Nyland | 4 |
| "Good Times" | In what city did the show take place? | Chicago, Illinois | 1 |
| "Three's Company" | In what order did the different blonde roommates appear on the show? | Chrissy, Terri, Cindy | 2 |
| "Coach" | What was the name of Coach's girlfriend? | Christine Armstrong | 3 |
| "Night Court" | Who was the second defense attorney? | Christine Sullivan | 4 |

It will be seen that the above table provides sufficient information for three complete question and response cards, each having four questions of varying levels of difficulty and with correct responses. The information shown in the above table is exemplary, and it will be understood that many more question and response cards incorporating additional questions of varying degrees of difficulty and responses therefor, would be included in the present game. Ideally, at least a few hundred such questions and responses, along with the titles of the television shows from which they are taken and the appropriate difficulty level, would be provided with the present game, in order to provide a large number of such question and response cards to preclude players memorizing the various questions and responses over any reasonable period of time and sessions of play of the present game.

The present game is played by first selecting a number of players. It is permissible for two or more players to form teams if desired, in order to accommodate a number of players larger than the number of columns of the board. The players or teams determine the order of play and corresponding column of the game board 10*a* or 10*b* in any suitable manner (cutting cards, tossing a die or dice or a coin, etc.). The game cards 32 are mixed or shuffled as required and placed with the questions and answers concealed (e.g., within a box or other suitable enclosure, so the questions and answers cannot be viewed) on a convenient suitable surface.

The game is begun by an opponent of the first player drawing a card 32 (e. g., the top card) from the stack, concealing the answer side 32*b* of the card 32 in his or her hand or in some other manner so the first player cannot see the answers, and reading each of the titles of the television programs and the corresponding levels of difficulty of each corresponding question, to the first player. The first player then selects a level of difficulty based upon the above information. (Other alternatives may be provided, such as providing only the program titles or level of difficulty.)

As the amount of advance (or setback) of a player's or team's position marker along the corresponding column of the game board at each turn is based upon the degree of difficulty of the question, the first player or team may choose to play more aggressively and select a question which is more difficult for that player to answer correctly. The reward for a correct answer to such a more difficult question, is a correspondingly greater advance along the corresponding column of the game board. On the other hand, should the player or team answer incorrectly, the position marker is set back a corresponding number of positions (but no farther back than the starting point on the game board), so each player or team must make an estimate of the chances of a correct answer before selecting a given level of difficulty at his or her turn.

Each player (or team) receives only a single question at each turn, with play proceeding to the next player (or team) whether the preceding player's or team's response was correct or incorrect. Player (or team) advance along the corresponding columns of the game board may be indicated by any conventional form of player position markers (e. g., different denominations of coins, etc.).

As an example of the above, a first player or team may select a level of difficulty of three. If the exemplary card 32 of FIGS. 2A and 2B is drawn by the opposing player, the third question, i. e., "What designer did Kramer model for?" would be read to the first player. If the first player responds correctly, that player's (or team's) position marker would be advanced a number of rows corresponding to the level of difficulty of the question (i. e., three rows for a correct response to a third level of difficulty question), e. g., to the third row of the first column of the board 10*a*, or position 12*c*.

Play then moves to the second player (or team), who selects a level of difficulty. They may choose a level of difficulty of four, in an attempt to gain an advantage over the first player. If they answer correctly, then their position marker is advanced to the fourth row of the second column, or position 14*d* (15*d* for the game board 10*b*). In the event an incorrect answer is given, their position marker would remain at the starting position or line, assuming the missed question occurred on the first turn, or at least that their position marker was still positioned at the starting area 24 (or 25, in the case of the game board 10*b*).

Play continues in the above manner, with each player or team receiving a single question at the level of difficulty they have selected, and advancing or setting back the corresponding position markers accordingly. As play continues toward the finish line 26 (or 27), there will be room for set back of position markers in the event of an incorrect response. As an example, a player or team having a marker on position 18*k* of the board 10*a* and missing a question at level two, would set back their marker to position 18*i*.

The present game may provide even further interest by providing for the setback of an opposing player's or team's marker, in the event of a correct response by another player or team at a predetermined level of difficulty. For example, let us assume that the second player or team has advanced their marker to position 14*r* of the board 10*a*, thus needing a correct response to only one more question at a level of three to win the game, while the first player or team has advanced only as far as position 12*m* of the board 10*a*, thus requiring at least two more turns and correct responses in order to finish. If the first player or team correctly responds to a question at the fourth or highest level of difficulty, then that player or team has the option of either advancing their own marker four positions, i. e. to position 12*q* of the board 10*a*, or alternatively setting back the marker of the second (or other) player by a predetermined number of positions.

In the preferred rules of play of the present game, a player or team correctly responding to a question at the fourth or most difficult level, may use that correct response to set back any other player or team position marker by two positions, or to the starting area 24 of the board 10*a* if the other marker has advanced only one or two positions from the starting area. In the present example, the first player or team may set back the second player's or team's marker by two positions, from position 14*r* to position 14*p* of the board 10*a*, thus requiring the second player or team to take at least two more turns in order to complete the game. The first player's or team's marker would remain on the same position 12*m* of the board 10*a*. (It will be seen that the above described examples may be applied to the board 10*b* of FIG. 1B by applying the corresponding odd numbers for corresponding board positions.)

It will be seen that the above described setback rule may be varied as desired, perhaps by allowing a setback amount equal to the amount the correctly responding player or team would have advanced had they chosen to do so, i. e., a setback of four positions for correctly responding to a question having a difficulty level of four. However, with expert teams, this may cause the game position to stagnate, as opposing player or team markers are set back as much as they are advanced. Other variations may be provided, such as splitting the advance and setback to allow the correctly responding player's or team's marker to advance by one position, while simultaneously setting back an opposing marker by one position. Also, a lower level of setback could be used, with a player or team correctly responding to a question at some predetermined level being allowed to set back an opponent's marker by a predetermined number of positions.

Play continues in the above manner, with play rotating between each player or team after each responds to a single question, until one of the position markers is advanced to the finish area 26 (27 for the board 10*b*), with that player or team winning the game. Alternatively, a time limit might be used to determine the winner, with the winning player or team being the player or team whose position marker has advanced farthest along their respective column toward the finish area 26 (board 10*a*) or 27 (board 10*b*) in a predetermined period of time. Such a time limited game might be desirable for those on a lunch hour, or having a limited amount of free time to play the present game.

The above described apparatus and rules of play are directed to a game having a game board and player position markers for keeping track of the score of the game. However, there may be times when it is inconvenient or impossible to use a game board and position markers on the board, such as during travel. Accordingly, the rules of play may be modified to permit keeping track of score by means of conventional pen and paper or other writing and recording implements and means, as desired (chalk board, etc.). The score for each successful response is added to any previous score for that player or team, with a running total being kept for each player or team. Such scorekeeping means still allows for the players or teams to be set back for incorrect responses, or to set back other players or teams in accordance with the rules described further above. In such situations, the appropriate amount is subtracted from the player's or team's score, as required.

In summary, the present board game will be seen to provide novel variations on other trivia and question and answer type games of the prior art. The present game, with its game board providing a series of parallel, straight playing paths, enables players to see at a glance the relative positions of all position markers, and their proximity to the common finishing area of the board. The rules of the present game add to the interest and excitement of the game, by permitting a player or team successfully responding at a predetermined higher level of difficulty, to use their success to set back an opponent's marker, rather than to advance their own marker. This results in considerably more interest and excitement, particularly near the end of the game when a correct response by an opponent at the highest level of difficulty, can make the difference between a player being able to win easily on the next round, and requiring two more rounds of play in order to have a chance to win.

It will be seen that the present game apparatus and rules may be adapted for use in just about any subject area. However, it is particularly well suited for use with questions relating to television programming, and more particularly popular situation comedies of years past. The subject creates a certain level of nostalgia and pleasant memories of past times for players, and thus will remain popular in times to come as well.

The present trivia game is not necessarily limited to the various game board apparatus discussed further above. The present game lends itself well to play using conventional hand recording means for keeping score (pencil and paper, chalk board, etc.). In such cases, the appropriate number of points are added to (or subtracted from, in accordance with the rules) each player's or team's score, until the end of the game is reached (e. g., predetermined time limit, score, etc., as previously agreed upon by the players). Thus, the present game may be played in a home or other environment providing for the setup of a game board, or ray be played in a situation not conducive to setting up a game board, such as in a moving automobile or other travel scenario. Regardless of the precise means of play, the present trivia game will provide considerable enjoyment to those players involved, along with considerable suspense at the end game due to the set back rules provided.

It is to be understood that the present invention is not limited to the sole embodiment described above, but encompasses any and all embodiments within the scope of the following claims.

I claim:

1. A method of playing a board game, comprising the following steps:

(a) providing a game board having a plurality of parallel, linear playing paths thereon extending from a common starting edge of the board to the opposite common finishing edge, with each of the playing paths divided into an equal number of positions;

(b) further providing a plurality of question and response cards, with each of the cards including at least a plurality of questions of differing levels of difficulty and answers corresponding to the questions;

(c) selecting at least one first and at least one second player, and determining an order of play among the players;

(d) randomly selecting a question and response card by the first player, and reading at least the differing levels of difficulty to the second player;

(e) selecting the level of difficulty of the question to be asked of the second player, by the second player;

(f) asking a question of the second player by the first player, corresponding to the level of difficulty selected by the second player;

(g) moving the second player position marker forward or the position marker of an opponent backward a number of spaces according to a correct response to the question and level of difficulty of the question, or moving the second player position marker backward a number of spaces according to an incorrect response to the question and level of difficulty of the question;

(h) having the first player take a turn in the same manner described for the second player; and (i) continuing in the above described manner until one of the players reaches the finishing edge of the game board.

2. The method of playing a board game according to claim 1, including the step of differentiating the playing paths on the game board by color.

3. The method of playing a board game according to claim 1, including the step of including the subject matter of the questions and responses on the playing positions of the game board.

4. The method of playing a board game according to claim 1, including the step of providing at least twenty different playing positions along each of the playing paths of the game board.

5. The method of playing a board game according to claim 1, including the step of providing at least four different questions and corresponding responses on each of the question and response cards.

6. The method of playing a board game according to claim 1, including the steps of:

(a) providing opposite first and second faces for each of the question and response cards; and (b) placing the questions on the first face of each of the cards, and placing the corresponding responses on the opposite second face of a corresponding one of each of the cards.

7. The method of playing a board game according to claim 1, including the step of formulating the questions and corresponding responses to relate to television situation comedy programs.

8. The method of playing a board game according to claim 7, including the steps of:

(a) placing the name of a television show on at least some of playing positions of the game board; and (b) formulating the questions and corresponding responses of the question and response cards to correspond with the names of the television shows placed on the playing positions of the game board.

9. The method of playing a board game according to claim 1, wherein the step of having a player select the level of difficulty of the question to be asked of that player includes the step of informing the player of the specific subject of the question before having the player select the level of difficulty of the question.

10. A method of playing a trivia game, comprising the following steps:

(a) providing a plurality of question and response cards, with each of the cards including at least a plurality of questions of differing levels of difficulty and answers corresponding to the questions;

(b) further providing conventional scorekeeping means for hand recording scores of the players during the course of play of the game, including a maximum score for the game;

(c) selecting at least one first and at least one second player, and determining an order of play among the players;

(d) randomly selecting a question and response card by the first player, and reading at least the differing levels of difficulty to the second player;

(e) selecting the level of difficulty of the question to be asked of the second player, by the second player;

(f) asking a question of the second player by the first player, corresponding to the level of difficulty selected by the second player;

(g) recording a positive score for the second player or a negative score for an opposing player on the scorekeeping means according to a correct response to the question and level of difficulty of the question, or recording a negative score for the second player on the scorekeeping means according to an incorrect response to the question and level of difficulty of the question;

(h) having the first player take a turn in the same manner described for the second player; and (i) continuing in the above described manner until one of the players reaches the maximum score for the game.

11. The method of playing a board game according to claim 10, including the step of providing at least four different questions and corresponding responses on each of the question and response cards.

12. The method of playing a board game according to claim 10, including the steps of:

(a) providing opposite first and second faces for each of the question and response cards; and (b) placing the questions on the first face of each of the cards, and placing the corresponding responses on the opposite second face of a corresponding one of each of the cards.

13. The method of playing a board game according to claim 10, including the step of formulating the questions and corresponding responses to relate to television situation comedy programs.

14. The method of playing a board game according to claim 10, wherein the step of having a player select the level of difficulty of the question to be asked of that player includes the step of informing the player of the specific subject of the question before having the player select the level of difficulty of the question.

* * * * *